United States Patent [19]

Serres

[11] 4,256,245

[45] Mar. 17, 1981

[54] GUN-MOUNTING APPARATUS

[76] Inventor: Paul J. Serres, 11283 Serres La., Woodburn, Oreg. 97071

[21] Appl. No.: 88,543

[22] Filed: Oct. 26, 1979

[51] Int. Cl.[3] ..... F41C 33/00

[52] U.S. Cl. ..... 224/273; 224/271; 224/911; 224/252; 220/18

[58] Field of Search ..... 224/273, 269, 271, 911, 224/912; 220/18, 85 H

[56] References Cited

U.S. PATENT DOCUMENTS

| | | | |
|---|---|---|---|
| 1,579,552 | 4/1926 | Ludlow | 248/200 |
| 1,579,553 | 4/1926 | Ludlow | 224/151 |
| 2,239,978 | 4/1941 | Sanford | 248/221.3 |
| 2,731,179 | 1/1956 | Bennett et al. | 224/911 X |
| 2,743,075 | 4/1956 | Johnson | 220/18 X |
| 2,773,473 | 12/1956 | Martin | 248/220.2 X |
| 2,789,742 | 4/1957 | DeSalvo | 224/271 |
| 3,796,358 | 3/1974 | Grubb | 224/255 |
| 3,907,182 | 9/1975 | Bryant | 224/252 |
| 4,113,217 | 9/1978 | O'Connell | 248/221.3 |

*Primary Examiner*—Steven M. Pollard
*Attorney, Agent, or Firm*—Kolisch, Hartwell & Dickinson

[57] ABSTRACT

Apparatus for mounting and locking a hand gun on a vehicle. The apparatus includes a mounting bracket which is fastenable to the vehicle, and a holster bracket having an attached hand gun holster. A pair of laterally spaced channels on opposed sides of the mounting bracket slidably receive laterally spaced flanges formed on associated sides of the holster bracket, for detachably mounting the holster bracket on the mounting bracket. With the holster bracket so mounted, a projection carried thereon is received within a slot formed in the mounting bracket. A cable lock threaded through the projection, with such received in the slot, and through the finger guard of a gun carried in the holster, prevents removal of the gun from the vehicle.

4 Claims, 3 Drawing Figures

GUN-MOUNTING APPARATUS

BACKGROUND AND SUMMARY

The present invention relates to gun-mounting apparatus, and in particular, to apparatus designed for attachment to a vehicle, to mount and lock a gun thereon.

A general object of the present invention is to provide safe and effective means for mounting and locking a hand gun on a vehicle.

It is another object of the invention to provide a gun-mounting apparatus which can be secured to a vehicle with conventional fasteners, with access to the fasteners being prevented when the apparatus is in a locked condition.

Still another object of the present invention is to provide such gun mounting apparatus which is simple in construction and operation.

The apparatus of the invention includes a mounting bracket which is fastenable to the vehicle, and a holster bracket having an attached hand gun holster. The holster bracket is detachably mountable on the mounting bracket, wherein a projection carried on one of the brackets is received within a slot formed on the other bracket. A cable lock usable with the apparatus, is threadable through the projection, with such received within the slot, and through the finger guard of a gun carried in the holster, to prevent removal of the gun from the vehicle.

In a preferred embodiment of the invention, a pair of laterally spaced channels on opposed sides of the mounting bracket slidably receive laterally spaced flanges formed in associated sides of the holster bracket, for detachably mounting the holster bracket on the mounting bracket. With the holster bracket so mounted, fasteners used to attach the mounting bracket to the vehicle are inaccessable, as a further safeguard against theft.

These and other objects and features of the present invention will become more fully apparent when read in connection with the following detailed description of a preferred embodiment of the invention, and the accompanying drawings, wherein.

DETAILED DESCRIPTION OF A PREFERRED EMBODIMENT OF THE INVENTION

Figure 1:
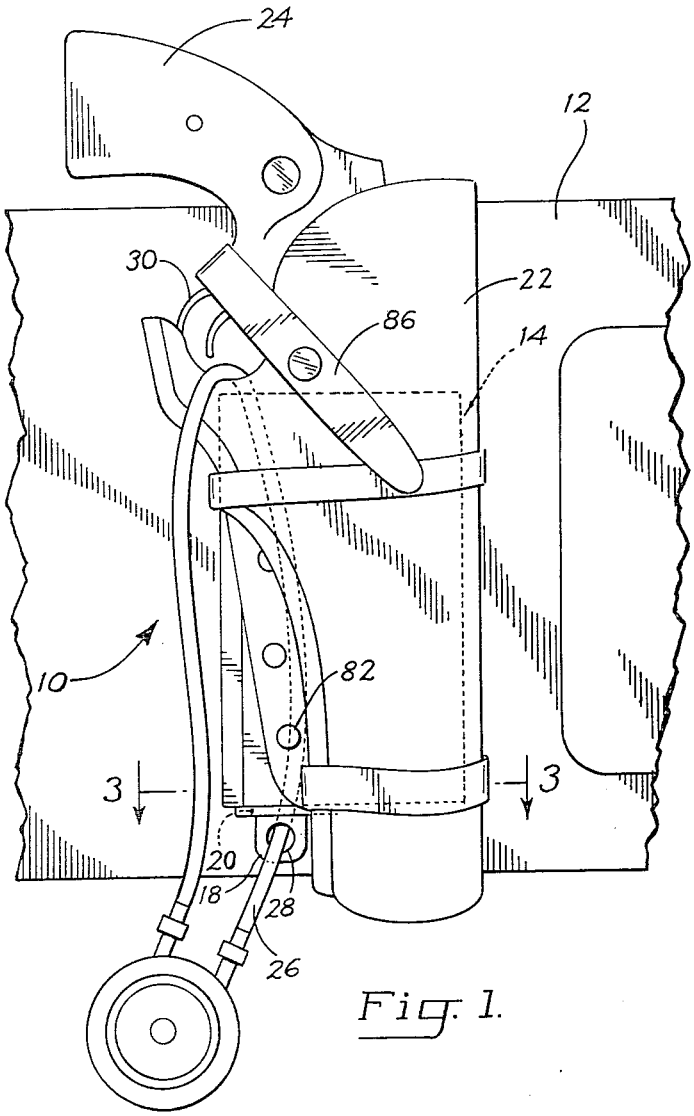
FIG. 1 is a front view of a vehicle-mounted apparatus constructed according to the present invention, with a hand gun locked thereto.

Apparatus constructed according to the present invention is indicated generally at 10 in the drawings, and in FIG. 1 is shown attached to a vehicle dashboard 12 (shown fragmentarily). Very generally, the apparatus includes two interlocking members which are seen best in FIG. 2. These members are a mounting bracket 14 which is adapted to be permanently secured to the vehicle, and a holster bracket 16 which is detachably mountable on bracket 14. A projection 18 formed at the lower end of bracket 16 is received within a slot 20 formed in the lower end of bracket 14 when bracket 16 is mounted thereon, as seen in FIG. 1. The apparatus further includes a holster 22 carried on bracket 16, for holding a hand gun 24, as shown in FIG. 1. With gun 24 held in holster 22 and bracket 16 mounted on bracket 14, a lockable cable 26 (FIG. 1) threaded through an opening 28 in projection 18, and through the gun's finger guard 30 prevents removal of the gun from the vehicle.

Figure 2:
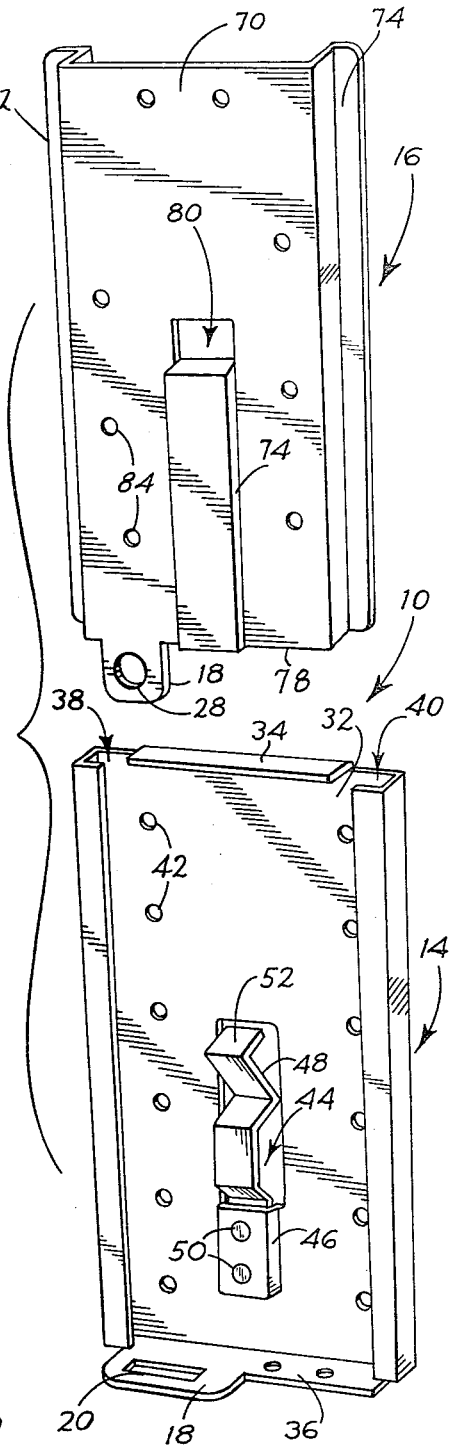
FIG. 2 is a perspective view of interlocking brackets used in the invention.

Looking now at details of the apparatus, and first with reference to FIG. 2, bracket 14 includes a plate 32 having top and bottom flanged ends 34, 36, respectively. Slot 20 is formed in the left side of end 36 in FIG. 2. The left and right side regions of plate 32 in FIG. 2 are fashioned, as shown, to form a pair of laterally spaced channels 38, 40. A plurality of holes, such as holes 42 formed in plate 32 intermediate channels 38, 40, are used in fastening bracket 14 to the vehicle, as will be described. An elongate rectangular slot 44 formed in plate 32 terminates, at its lower end in FIG. 2, in a raised plate portion 46. The just-described structures in bracket 14 are preferably integrally fashioned from a wrought-iron plate.

Slot 44 is dimensioned to receive therethrough portions of an elongate spring 48 which is attached, at its lower end in FIG. 2, to portion 46 by rivets 50. The upper end of spring 48 forms an outwardly extending V-shaped projection 52, for a purpose to be described.

Figure 3:
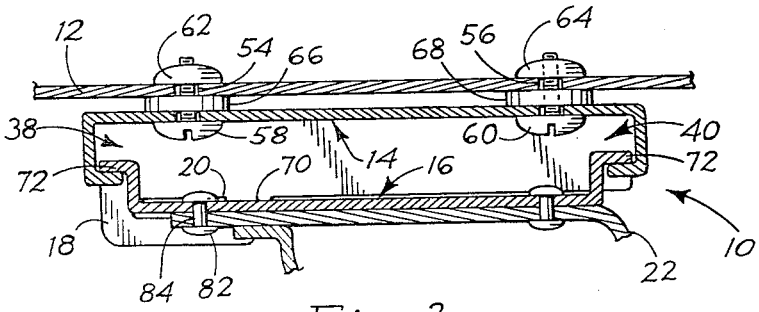
FIG. 3 is a sectional view taken generally along line 3—3 in FIG. 1.

To mount bracket 44 on a vehicle—and in particular, on the vehicle's dashboard 12—a number of holes, corresponding to the positions of holes 42, with bracket 14 in an upright position, are drilled in the dashboard. With reference to FIG. 3, two such holes are indicated at 54, 56. A number of screwhead bolts, such a bolts 58, 60 seen in FIG. 3, extend through aligned holes in bracket 14 and dashboard 12 and are secured, at the back surface of dashboard 12 (the top surface in FIG. 3) by round flange nuts, such as nuts 62, 64, respectively. Bolts 58, 60 are tightened sufficiently to compress elastomeric spacers, such as spacers 66, 68 interposed between bracket 14 and the confronting face of the dashboard. The elements just described are also referred to herebelow as means for detachably fastening bracket 14 on a vehicle. It can be appreciated that detachment of bracket 14 from dashboard 12 can be performed from the dashboard's front side only, since access to the rear of the dashboard is limited and nuts, such as nuts 62, 64, are not tool-engageable in any case.

Turning again to FIG. 2, bracket 16 includes a plate 70 whose side regions are bent downwardly (away from the reader) and outwardly to form a pair of laterally spaced flances 72, 74. Flanges 72, 74 are dimensioned to be slidably received within channels 38, 40, respectively, with end 34 being received in the channel in bracket 16 formed between the two flanges. Channels 38, 40 and flanges 72, 74 slidably engageable therewith are also referred to herebelow as interlocking means for detachably mounting bracket 16 on bracket 14. A vertically extending embossment 74 formed on plate 70 accommodates downward movement of this plate over spring 48 and portion 46 when bracket 16 is being mounted on bracket 14. Bracket 16 also is fashioned preferably from a wrought-iron plate or the like.

In mounting bracket 16 on bracket 14, flanges 72, 74 are moved downwardly through channels 38, 40, until the lower edge 78 of plate 70 makes contact with end 36 on bracket 14, defining a seated, interlocked position. At such position, projection 18 extending from the lower edge of plate 70 is received in slot 20, with opening 28 on projection 18 extending below member 36, as seen in FIG. 1. Also in such seated position, projection 52 is received in a suitably positioned rectangular aperture 80 formed in plate 70, with the upper edge of projection 52 pressing against the upper edge of aperture 80 to bias bracket 16 downwardly toward its seated position. It can be appreciated that the just described means for biasing bracket 16 toward a seated position, also referred to herebelow as seating means, prevents the two interlocked brackets forming apparatus 10 from rattling when the vehicle to which the apparatus is attached is moving.

Completing the description of bracket 16, holster 22 is permanently mounted on plate 70 by a plurality of rivets, such as rivet 82 (FIGS. 1 and 3) extending through openings, such as openings 84, formed in plate 70 (FIG. 2). Holster 22 is a conventional hand gun holster, formed of leather or the like, and includes, conventionally, a snap-lock strap 86 for securing the hand gun in the holster.

Operation of apparatus 10 will now be described. Bracket 14 is mounted on a vehicle—for instance, the dashboard of a vehicle—in the manner described, wherein access to the means used in fastening bracket 14 to the vehicle is prevented when brackets 14, 16 are interlocked. To lock gun 24 on the vehicle, the gun is holstered, as shown in FIG. 1, and bracket 16 is mounted on bracket 14, wherein projection 18 is received in slot 20. Cable 26 of a conventional cable lock is threaded through opening 28 and through finger guard 30, also as shown. In the locked configuration shown in FIG. 1, cable 26 serves a dual purpose: its passage through opening 28 prevents removal of bracket 16 from bracket 14, and its passage through finger guard 30 prevents removal of the gun from bracket 16, and more particularly from projection 18 thereof. Projection 18 and opening 28 therein thus cooperate with slot 20 to provide means enabling locking of bracket 16 on bracket 14, and locking of gun 24 on apparatus 10.

To remove gun 24 from the vehicle, cable 26 is removed, permitting gun 24 to be removed from holster 22 or, optionally, to allow bracket 16 and the gun holstered therein to be removed from bracket 14. In the latter case, bracket 14 provides a convenient portable holster for the gun.

From the above, it can be appreciated how various objects of the present invention are met. The apparatus can be secured to a vehicle, with detachment of the apparatus being prevented when such is in a locked condition. The apparatus allows a hand gun to be carried in a holstered, locked condition on the vehicle, with either the gun, or the gun and holster being easily detachable from the vehicle when the apparatus is unlocked. The apparatus can be constructed so that substantially only the holster is visible, and thus the apparatus can be made quite attractive. As another advantage, the interlocking components of the apparatus, when mounted on a vehicle, are held in a relatively spring-biased position to prevent the apparatus from rattling during vehicle movement.

While a specific embodiment of the present invention has been described herein, it is obvious that various changes and modifications may be made without departing from the spirit of the invention.

It is claimed and desired to secure by Letters Patent:

1. Apparatus for mounting a hand gun on a vehicle, said apparatus comprising a mounting bracket adapted to be permanently secured to the vehicle, a holster bracket carrying thereon a holster adapted to receive a hand gun, one of said brackets having a projection, the other of said brackets having a slot, interlocking means on said brackets for detachably mounting said holster bracket on said mounting bracket, wherein said projection is received in said slot, and means enabling locking of said projection, with such received in said slot.

2. The apparatus of claim 1, wherein said interlocking means comprises a pair of laterally spaced channels formed on one of said brackets and a pair of laterally spaced flanges formed on the other of said brackets, and slidably receivable in said channels.

3. The apparatus of claims 1 or 2 which further includes seating means for biasing said holster bracket in a seated position on said mounting bracket, wherein said projection is received in said slot.

4. Apparatus for mounting a hand gun on a vehicle said apparatus comprising a mounting bracket adapted to be secured to the vehicle, detachable fastening means for securing said mounting bracket on the vehicle, a holster bracket carrying thereon a holster adapted to receive a hand gun, one of said brackets having a projection, and the other of said brackets having a slot, interlocking means on said brackets for detachably mounting said holster bracket on said mounting bracket, wherein said projection is received in said slot, and access to said fastening means is prevented, and means enabling locking of said projection, with such received in said slot.

* * * * *